United States Patent [19]

Paulshus et al.

[11] Patent Number: 4,940,361

[45] Date of Patent: Jul. 10, 1990

[54] DEVICE IN A FLEXIBLE TENSION LEG

[76] Inventors: Bjorn Paulshus, Slengasen 7, 2020 Skedsmo, Norway; Phil Hawley, Minwear Crowthrone Farm, Crowthrone, Berkshire, United Kingdom

[21] Appl. No.: 371,584

[22] Filed: Jun. 26, 1989

[30] Foreign Application Priority Data

Jun. 24, 1988 [NO] Norway ..... 882804

[51] Int. Cl.[5] ..... B63B 21/50; F16B 21/00

[52] U.S. Cl. ..... 405/224; 405/203; 403/133

[58] Field of Search ..... 403/132, 133, 137; 285/23, 184; 405/195, 202, 203, 224, 227; 114/265

[56] References Cited

U.S. PATENT DOCUMENTS

| | | | |
|---|---|---|---|
| 4,098,527 | 7/1978 | Herbert et al. | 285/234 X |
| 4,320,993 | 3/1982 | Hunter | 405/224 |
| 4,374,630 | 2/1983 | Fraser | 405/224 |
| 4,391,554 | 7/1983 | Jones | 405/224 |
| 4,439,055 | 3/1984 | Quigg et al. | 405/202 X |

*Primary Examiner*—Randolph A. Reese
*Assistant Examiner*—John Ricci
*Attorney, Agent, or Firm*—Young & Thompson

[57] ABSTRACT

In a flexible tension leg member an adjustable spacer is provided between the coaxial tension leg members joined in the member.

7 Claims, 2 Drawing Sheets

DEVICE IN A FLEXIBLE TENSION LEG

The present invention relates to a device in a flexible tension leg member, as stated in the preamble of claim 1.

More precisely, the invention relates to a device in a flexible member intended for use in a tension leg of a tension leg platform, at the spot where the tension leg from the sea floor meets the platform proper, i.e. the platform column extending down into the water and through which the tension leg continues upwards to a suitable tensioning means above the surface of the sea. The tension leg from the sea floor, showing slight pendular movement, is connected with the tension leg extending up through the platform by the aid of said flexible member.

The elastomeric annular bearing member provided in said flexible member is subjected to compression loads when tensioned in the tension leg. Said flexible bearing member permits swinging movement between both tension leg members which are mutually connected by the aid of the flexible member. The spacer provided between tension leg members acts to transmit compressive forces between both tension legs.

The elastomeric bearing member is designed to tolerate high compressive loads, but it is relatively sensitive to tension loads. This will manifest itself in an especially disadvantageous manner in the phase before the tension leg is mounted in place and biased. Swinging movement of the flexible member before bias is provided, may influence the elastomeric bearing member so adversely that it is destroyed.

It is an object of the present invention to eliminate the mentioned disadvantage. According to the invention this is achieved by the fact that the spacer has an adjustable stop as stated in the characterizing part of claim 1. By the aid of said adjustable stop the spacer can be caused to exert a thrust load on the tension leg member which is secured in place by the aid of elastomeric bearing member. Such thrust load is transmitted to the elastomeric bearing member which is, thus, precompressed. In this manner a certain clamping or attachment of the flexibly mounted tension leg member is achieved. Any jolting or movement during transport of the premounted flexible tension leg member will then have no disadvantageous effect on the elastomeric bearing member. The adjustable design of the spacer may also. advantageously, be used for mutual aligning and adaption of separate components during premounting of components to provide an articulated unit.

Figure 1:
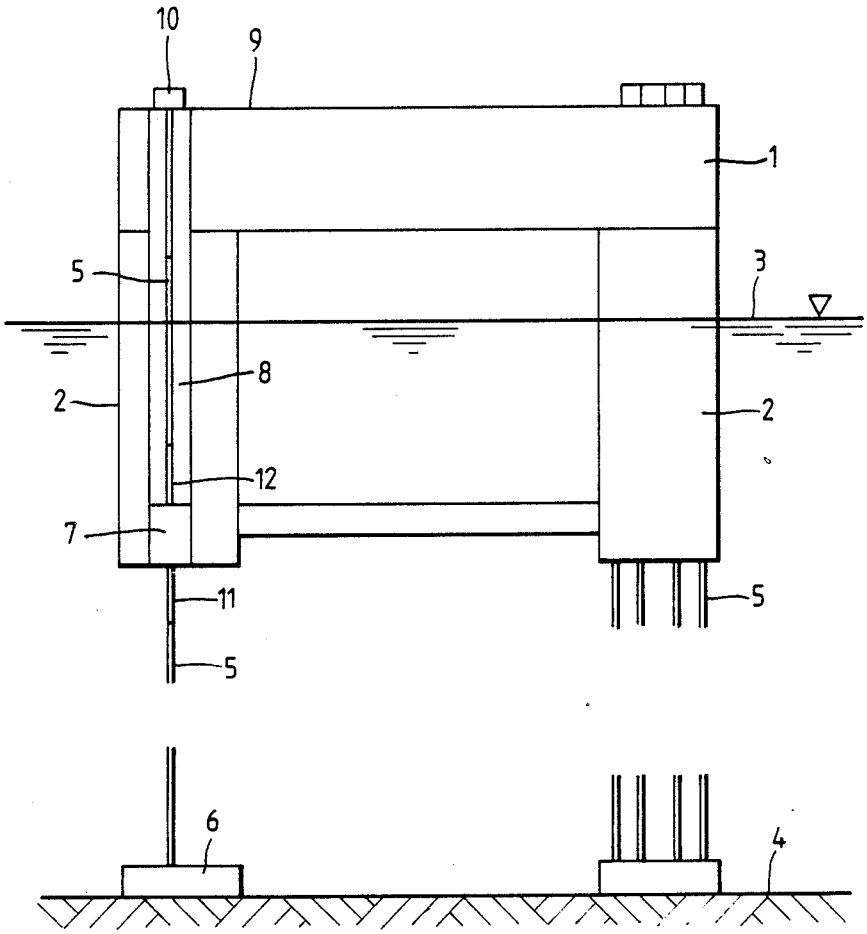
Figure 2:
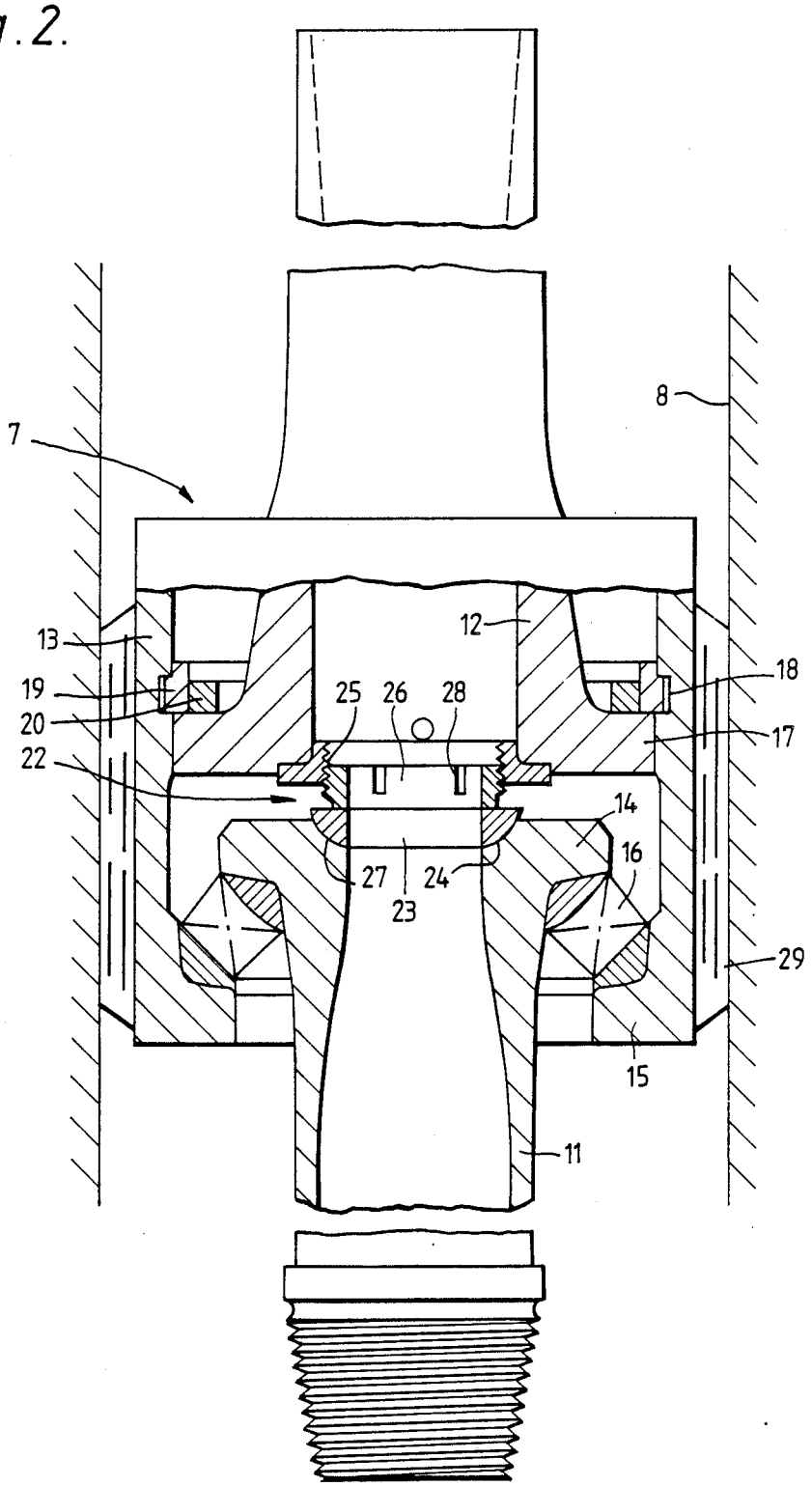

The invention is disclosed in more detail below with reference to the drawings, where FIG. 1 is a diagrammatical view of a tension leg platform, FIG. 2 is an elevation, partly in section of a flexible tension leg member, with a device according to the invention.

The tension leg platform which is diagrammatically shown in FIG. 1. mainly comprises a deck 1, and a number of columns 2. As shown, the platform is semi-submersed with deck 1 above the water surface 3, whereas columns 2 extend some distance down into the water. The platform is anchored to the sea floor 4 by the aid of a number of tension legs 5. In FIG. 1 column 2 on the right hand side is indicated to be anchored to the sea floor 4 by four tension legs 5. In connection with column 2 on the left hand side. three of the tension legs are omitted, and only one tension leg is shown. It extends upwards from an anchoring foundation 6 on the sea floor 4 to a flexible member 7. Flexible member 7 is provided in a vertical shaft extending upwards through column 2 to a point above the water surface, in this case to top surface 9 of deck 1. From flexible member 7 tension leg 5, furthermore, extends up through shaft S to a tensioning device 10 above the water surface.

Each tension leg 5 is designed like a drill string, thus, comprising tension leg elements or pipe lengths which are screwed together. Flexible member 7, in fact, forms a flexible member between a lower tension leg element 11, extending down into the water from member 7, and an upper tension leg element 12, extending upwards in shaft 8.

The flexible member and device according to the invention will now be explained in more detail with special reference to FIG. 2.

Flexible member 7 comprises a casing in the shape of a hollow cylinder 15. A first tension leg element projects into cylinder 13 from below, whereas a second coaxial tension leg element 12 projects into cylinder 13 from the top end of the cylinder. On the first or lower tension leg element 11 an outwards extending flange 14 is provided. Cylinder 13, as shown, has an inwards extending bearing flange 15. An elastomeric annular bearing member 16 surrounds tension leg element and is in contact with bearing flange 14, and inwards extending bearing flange 15, respectively.

The elastomeric bearing member is of a kind known per se. It is an elastomeric bearing member which is well-known to those skilled in the Art in connection with flexible members of &his general kind. Such elastomeric bearing members are disclosed in detail, inter alia, in U.S. Pat. No. 4,098,527, and in U.S. Pat. No. 4,320,993.

The second or upper tension leg element 12 is also provided with an outwards extending flange 17, but this flange is rigidly secured in cylinder 13. In the inner wall of cylinder 13 a circular groove 18 is provided with an inserted split locking ring 19. Said split locking ring 19 is kept in groove 18 by the aid of a retaining ring 20 which is secured on flange 17 by screwing.

Between tensioning leg elements 11 and 12 a spacer element 22 is provided. In the shown embodiment spacer element 22 comprises three members, viz. an annular member 25 having a convex spherical end face, an internally threaded mounting ring 25, and an externally threaded adjusting ring 26. Mounting ring 25 is firmly screwed onto the end of tension leg member 12, whereas adjusting ring 26 is screwed into mounting ring 25. Adjusting ring 26, as shown, bears against annular member 23. The spheric face of annular member 23 sits in a concave spheric bearing face 27 which is provided in the end of tension leg element 12. The spheric faces have a common center, a center which, in fact, coincides with the rotational center of elastomeric bearing member 16.

Adjusting ring 26 is provided with a number of notches 28 intended for cooperation with a suitable turning tool.

Cylinder 13 is provided with external elastomeric bearing members 29, by the aid of which cylinder 13 is supported against shaft wall 8 for transmission of transversal forces.

The unit shown in FIG. 2 (apart from shaft 8) is preassembled and placed in shaft 8 as a unit.

Preassembly occurs by placing cylinder 13 on a suitable scaffold. Bearing member 16, and tension leg element 11 are put in place from above. Then annular ring member 23 is placed in backing shell 27. Mounting ring 25 is mounted on the end of upper tension leg element 12, together with screwed in adjusting ring 26. Tension leg element 12 is then lowered to the position shown in FIG. 2. Adjustment of the position of tension leg element 12 to place the rear side of flange 17 aligned with lower edge of groove 18 in cylinder 13, may advantageously be achieved by corresponding rotation of adjusting ring 26. Split locking ring 19 is mounted and locked when retaining ring 20 and claws 21 are mounted.

By the aid of adjusting ring 26 it is now possible to precompress elastomeric bearing member 16. This is done by screwing adjusting ring 26 out of retaining ring. 25, i.e. in a downward direction. Adjusting ring 26 will then thrust towards annular member 2S. In this manner, a compression force of a few tons, e.g. up to 50 tons, may suitably be achieved, resulting in a suitable fixation and clamping of lower tension leg member 11, so that the latter is prevented from so heavy movement during necessary handling and transport of unit 7 that& hearing member 16 is subjected to destructive tension forces.

When flexible member 7 is placed in shaft 8 and connected to the total tension leg 5, the tension leg is biased, e.g. by tension force up to 1500 tons. Due to this bias a slight gap (in the order of mm) will form between spherical faces 24 and 27. Slight axial movement in an upward direction of tension leg element 11 will, thus, be permitted, without any thrust forces worth mentioning being transmitted through spacer 22.

The spacer can, obviously, be reversed, also the convex spherical face may be provided on the tension leg element.

Having described our invention, we claim:

1. A device in a flexible tension leg member of the kind that comprises a hollow cylindrical casing, first and second coaxial tension leg elements which extend into said casing from its opposite ends. an outward projecting bearing flange at the end of the first tension leg element which sits in said casing, an inward projecting bearing flange in said casing, an elastomeric bearing member surrounding the first tension leg element and bearing against its bearing flange and on the other side bearing against inward projecting bearing flange in said casing, a rigid connection between said second tension leg and casing and a spacer between opposite tension leg elements inside said casing, said spacer comprising a spheric face facing a spheric bearing face on one tension leg element, characterized in that the spacer has an adjustable stop towards the other of opposite tension leg element ends.

2. A device according to claim 1, characterized in that the adjustable stop comprises a screw/nut means.

3. A device according to claim 2, characterized in an internally threaded ring which is attached to tension leg element, and an externally threaded ring which is screwed into said internally threaded ring.

4. A device according to claim 3, characterized in that said externally threaded ring is provided with notches on its internal circumference for cooperation with a rotating tool.

5. A device according to claim 1, characterized in that spheric bearing face is provided on the end of first tension leg element.

6. A device according to claim 1, characterized in that spacer comprises an annular member having a spheric end face.

7. A device according to claim 1, characterized in that the spherical face on the spacer is the convex spherical face.

* * * * *